US007070463B2

(12) United States Patent
Arai et al.

(10) Patent No.: US 7,070,463 B2
(45) Date of Patent: Jul. 4, 2006

(54) WATERPROOF RELAY CONNECTOR

(75) Inventors: Atsushi Arai, Nei-gun (JP); Kaoru Kanda, Nei-gun (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 11/045,453

(22) Filed: Jan. 28, 2005

(65) Prior Publication Data

US 2005/0181681 A1 Aug. 18, 2005

(30) Foreign Application Priority Data

Feb. 18, 2004 (JP) ..... 2004-040866

(51) Int. Cl.
*H01R 11/09* (2006.01)

(52) U.S. Cl. ..... 439/787; 439/276; 439/578

(58) Field of Classification Search ..... 439/271–276, 439/548, 587, 588, 787
See application file for complete search history.

(56) References Cited

U.S. PATENT DOCUMENTS 2,117,029 A * 5/1938 Larsson ..... 439/289
2,823,249 A * 2/1958 Curtiss ..... 174/87
3,489,988 A * 1/1970 Carnaghan ..... 439/274
3,564,477 A * 2/1971 Paompei ..... 439/17
3,798,588 A * 3/1974 Howe et al. ..... 439/547
4,586,774 A * 5/1986 Didier ..... 439/274
4,744,775 A * 5/1988 Pauza ..... 439/607
6,171,144 B1 * 1/2001 Stone ..... 439/587
6,280,208 B1 * 8/2001 Masuda et al. ..... 439/98
2004/0121639 A1 * 6/2004 Yaworski et al. ..... 439/276
2005/0181681 A1 * 8/2005 Arai et al. ..... 439/787

FOREIGN PATENT DOCUMENTS

JP 2003-317825 11/2003

* cited by examiner

*Primary Examiner*—James R. Harvey
(74) *Attorney, Agent, or Firm*—Pearne & Gordon LLP

(57) ABSTRACT

The waterproof relay connector for connecting a lead wire includes a connector housing having a lead wire insertion hole, and lead wire retaining means for retaining the lead wire inserted in the lead wire insertion hole, an elastic portion having a through hole extending along the lead wire insertion hole, and a terminal for connection to the lead wire are provided in the connector housing. The lead wire is passed through the through hole in the elastic portion, and a conductor of the lead wire is resiliently connected to the terminal, so that a seal is formed between an inner peripheral surface of the through hole in the elastic portion and an outer peripheral surface of a covering portion of the lead wire.

10 Claims, 9 Drawing Sheets

- PRIOR ART -

- PRIOR ART -

WATERPROOF RELAY CONNECTOR

BACKGROUND OF THE INVENTION

This invention relates to a waterproof relay connector to which a lead wire can be removably connected.

A conventional commonly-used waterproof relay connector is of the type as shown in FIG. 12, in which a plug 111 and a socket 112 are fitted together.

A terminal 121 and a contact 122, each having a lead wire 101 press-fastened thereto, are received respectively within housings 111*a* and 112*a* made of an insulator, and a resin 160 is filled in each of the housings 111*a* and 112*a*, thereby fixing the terminal 121 and the contact 122 respectively to these housings.

In this case, when the plug 111 and the socket 112 are fitted together, the lead wires are connected together.

In this kind of the relay connector, a waterproof effect is achieved by providing the resins 160 which is rubber insulators respectively at the opposite sides or by providing O-rings at the fitting surface.

However, with this structure in which the lead wire is press-fastened to the terminal, and the resin is filled to provide an integrally-molded construction, when this connector is to used as a waterproof relay connector, for example, between facilities, the connector need to be beforehand mounted on relevant apparatuses since this connector can not be mounted at the field.

Therefore, there was a drawback that when the facilities were to be changed, the arrangement could not be changed into a parallel connection or a series connection.

A terminal block as shown in FIG. 13 is also known.

This terminal block 110 is of the type in which a lead wire 101 is inserted thereinto, and is retained by a spring portion 130. The lead wire 101 can be easily removed by manually pushing a lever 140 to cancel the retaining engagement of the spring portion 130 with the lead wire. However, this terminal block is designed to connect the lead wire to facilities, and its structure is too large to be used as a relay connector, and besides has no waterproof ability.

JP-A-2003-317825 discloses a technique in which a retaining piece portion is provided within a housing, and a cable is held by this retaining piece portion, and is connected to a terminal block, and a cancellation button is pushed in a cable inserting direction to push the retaining piece portion, thereby removing the cable from the terminal block.

However, an insertion hole for the cable and an insertion hole for the cancellation button have no waterproof ability, and beside this structure is large in size.

Patent Document 1: JP-A-2003-317825

SUMMARY OF THE INVENTION

In view of the above technical problem, it is an object of this invention to provide a waterproof relay connector in which its structure is compact, and has a waterproof ability, and a lead wire can be easily connected to and disconnected from the connector, and a length of connection of the lead wire can be easily adjusted at the field.

Embodiments of a waterproof relay connector of the present invention include the following arrangement:

- a connector housing;
- a lead wire insertion hole that is formed through the connector housing;
- a lead wire retaining portion that retains a lead wire and is inserted in the lead wire insertion hole;

- an elastic portion that has a through hole though which the lead wire passes and is inserted in the lead wire insertion hole; and
- a terminal connected to the lead wire, where the lead wire is passed through the through hole of the elastic portion, and is connected to the terminal, so that a seal is formed between and inner peripheral surface of the through hole of the elastic portion and the lead wire.

BRIEF DESCRIPTION OF THE DRAWINGS

FIG. 1 shows a preferred embodiment of a waterproof relay connector of the present invention.

FIG. 5 shows an opening portion and its vicinity before a lead wire is connected to the connector.

FIG. 6 shows the opening portion and its vicinity after the lead wire connected to the connector.

FIG. 7 shows the opening portion and its vicinity, showing a condition in which the lead wire is to be removed.

FIG. 9 is a schematic view showing the condition of the lead wire and the elastic portion when mounting the lead wire.

DETAIL DESCRIPTION OF PREFERRED EMBODIMENTS

FIG. 1 shows a preferred embodiment of a waterproof relay connector 10 of the invention.

Figure 1A:
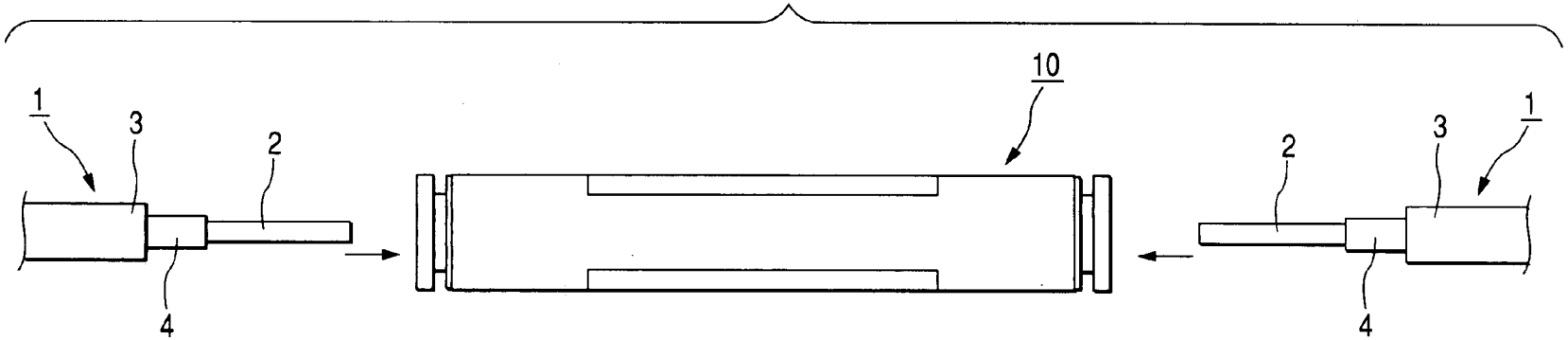
FIG. 1A is a side-elevational view thereof.
Figure 1B:
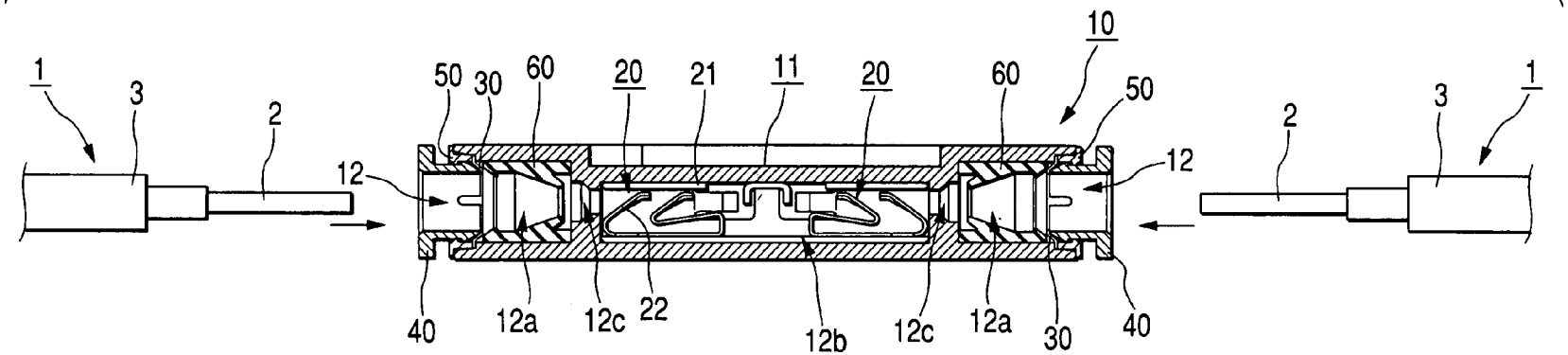
FIG. 1B is a cross-sectional view thereof.

FIG. 1A is a side-elevational view of the waterproof relay connector, and FIG. 1B is a cross-sectional view thereof.

A lead wire 1 comprises an outer covering (commonly referred to as a sheath) 3, and a conductor 2 covered with an inner covering 4 made of an insulator. This invention can be applied to any of single wires having a covering portion.

As shown in FIG. 1B, a lead wire insertion hole 12 is formed in each of front and rear half portions of the waterproof relay connector 10, and a terminal 20, a elastic portion (rubber bushing) 60, a retaining spring member 30, a ring-like retaining member 50 and a push-in member 40 are provided within each lead wire insertion hole 12, and are arranged in this order from an inner end portion of this insertion hole 12.

A lead wire covering-receiving portion 12*a* is formed near to an opening portion of the lead wire insertion hole 12.

A through hole 12*c* is disposed inwardly of the lead wire covering-receiving portion 12*a* in a lead wire inserting direction, and this through hole 12*c* is smaller in inner diameter than the lead wire insertion hole 12, and communicates with a terminal receiving portion 12*b*.

The terminal 20 is provided in the terminal receiving portion 12*b*, and this terminal has a spring-like contact portion 22 and a conducting portion 21 disposed in opposed relation to the contact portion 22.

Figure 2A:
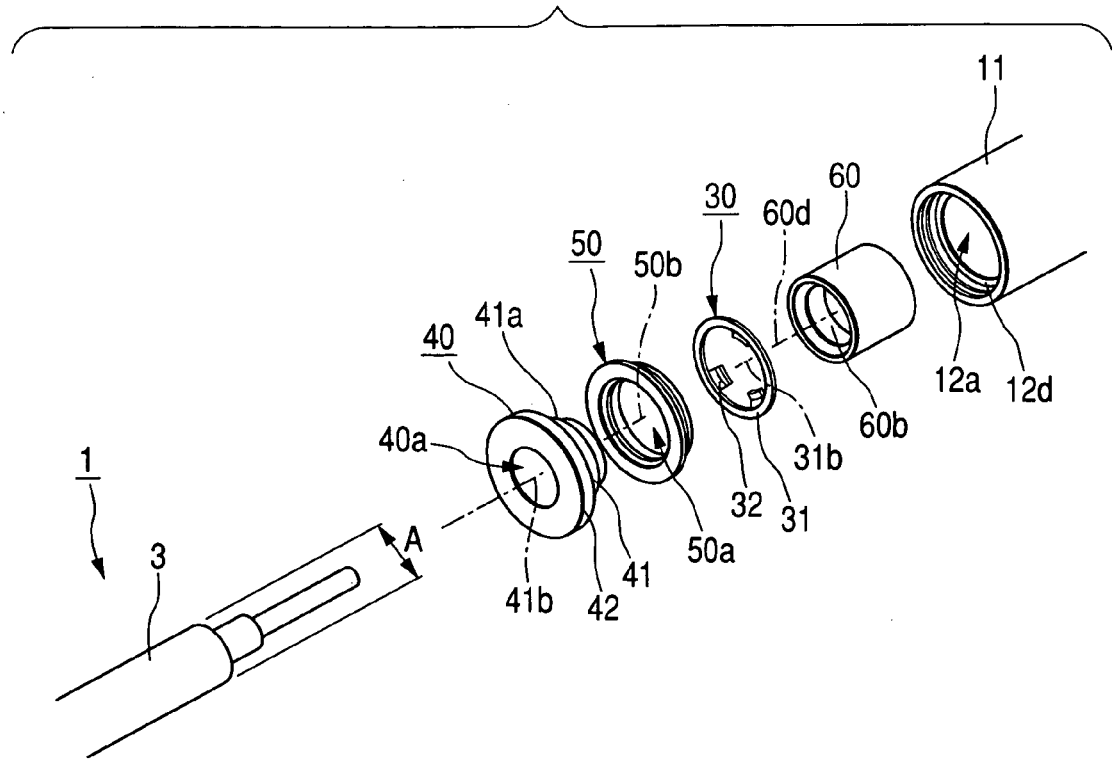
FIG. 2A is an exploded view showing a lead wire insertion hole portion of the connector of the invention.
Figure 2B:
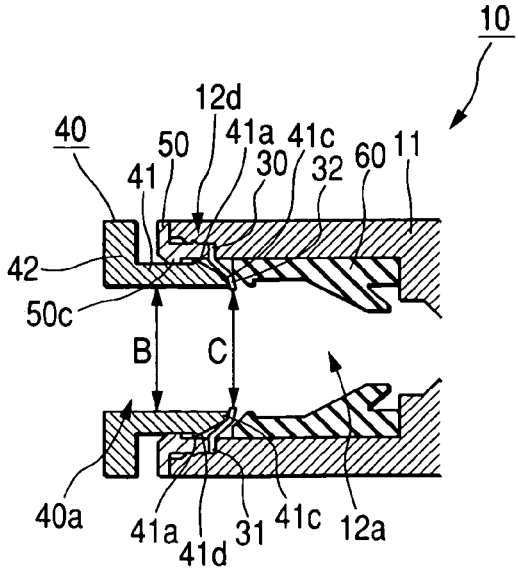
FIG. 2B is a cross-sectional view of an end portion of the connector in the vicinity of a lead wire covering-receiving portion.

FIG. 2A is an exploded view showing a portion of the connector in the vicinity of the lead wire covering-receiving portion, and FIG. 2B is a cross-sectional view of the end portion of the connector in the vicinity of the lead wire covering-receiving portion.

The lead wire covering-receiving portions 12*a* are formed respectively in opposite end portions of a generally-cylindrical connector housing 11, and are open respectively to the opposite ends thereof. A stair-like step portion 12*d* is formed in an edge portion of this opening portion.

The elastic portion 60, the retaining spring member 30, the ring-like retaining member 50 and the push-in member 40 are sequentially fitted in the lead wire covering-receiving portion 12*a*.

The elastic portion 60 has a generally cylindrical shape, and has a through hole 60*b*, and an outer peripheral surface of this rubber portion 60 is held in sealing engagement with an inner peripheral surface of the lead wire covering-receiving portion 12*a*.

Figure 3B:
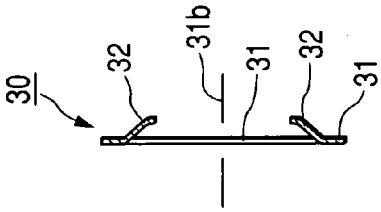
FIG. 3B is a cross-sectional view taken along the line a—a of FIG. 3A.
Figure 3A:
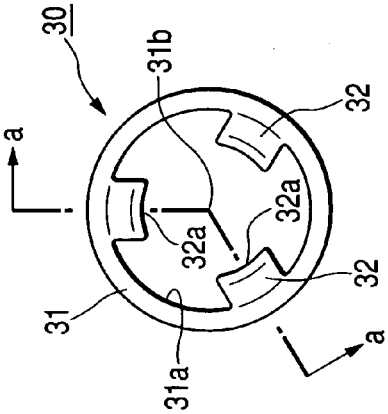
FIG. 3A shows a retaining spring member.

FIG. 3A shows the retaining spring member 30, and FIG. 3B is a cross-sectional view taken along the line a—a of FIG. 3A.

The retaining spring member 30 includes a ring-like annular portion 31, and resilient piece-like claws 32 extending from an inner peripheral edge 31*a* of the annular portion 31 toward a center axis 31*b* of this annular portion 31. Distal end portions 32*a* of the resilient claws 32 have such a shape that these ends 32*a* are disposed on a circle which has its center disposed on the center axis 31*b* disposed in concentric relation to the annular portion 31.

As shown in FIG. 2B, the retaining spring member 30 is mounted in the lead wire covering-receiving portion 12*a* in such a manner that the annular portion 31 is held between the ring-like retaining member 50 and the step portion 12*d* formed on the inner periphery of the lead wire covering-receiving portion 12*a*.

The push-in member 40 has a flange 42 formed on an outer periphery of its tubular body 41.

A tapering portion 41*d* is formed on that end of the tubular body 41 facing away from the flange 42, and is tapering toward its distal end.

A restricting portion 41*a* is formed into an annular shape on the outer periphery of the tubular body 41, and is disposed at that end of the tapering portion 41*d* close to the flange 42.

The ring-like retaining member 50 has a ring-like shape, and the tubular body 41 of the push-in member 40 is inserted in a hole 50*a* in this ring-like retaining member 50.

An inner peripheral projection 50*c* for restricting the restricting portion 41*a* of the push-in member 40 is formed on an inner peripheral surface of the hole 50*a*.

The ring-like retaining member 50 is press-fitted in the step portion 12*d* that formed in the edge portion of the opening portion of the lead wire covering-receiving portion 12*a*, in such a manner that the retaining spring member 30 is fixedly held between this ring-like retaining member 50 and the inner end of the step portion 12*d*.

On the other hand, the push-in member 40 is mounted in the lead wire covering-receiving portion 12*a* so as to slide between the push-in member restricting portion 41*a* and the flange 42.

The main purpose of the ring-like retaining member 50 is to fix the retaining spring member 30 to the connector housing 11, and the provision of this retaining member 50 is not always necessary, and the retaining spring member 30 may be mounted directly on the connector housing 11, in which case the inner peripheral projection 50*c* is formed on the inner surface of the lead wire insertion hole 12 in the connector housing 11.

As shown in FIGS. 2A and 2B, the push-in member 40, the ring-like retaining member 50, the retaining spring member 30 and the elastic portion 60 are mounted in the lead wire covering-receiving portion 12*a* of the waterproof relay connector in such a manner the center axis 41*b* of the tubular body 41, a center axis 50*b* of the ring-like retaining member 50, a center axis 31*b* of the annular portion 31 and a center axis 60*d* of the elastic portion 60 coincide with one another.

An outer diameter of the tubular body 41 of the push-in member 40 is smaller at the tapering portion 41*d* than an inner diameter of the annular portion 31 of the retaining spring member 30. In the mounted condition of the push-in member, a terminal-side end 41*c* of the tubular body 41 is disposed in opposed relation to the resilient claws 32.

On the other hand, an inner diameter B of the tubular body 41 is slightly larger than an outer diameter A of the outer covering 3 of the lead wire 1 to be connected to the connector 10.

A diameter C of a circle on which the distal ends of the resilient claws 32 of the retaining spring member 30 are disposed is slightly smaller than the outer diameter A of the outer covering 3 of the lead wire 1.

With the thus determined diameters, when the tubular body 41 of the push-in member 40 is slid toward the inner end of the lead wire covering-receiving portion 12*a* in the direction of the center axis, the terminal-side end 41*c* of the tubular body 41 is brought into abutting engagement with the resilient claws 32 of the retaining spring member 30.

When the lead wire 1 is inserted through the hole 40*a*, the lead wire advances while its outer covering 3 slightly forces the resilient claws 32 radially outwardly.

Figure 4:
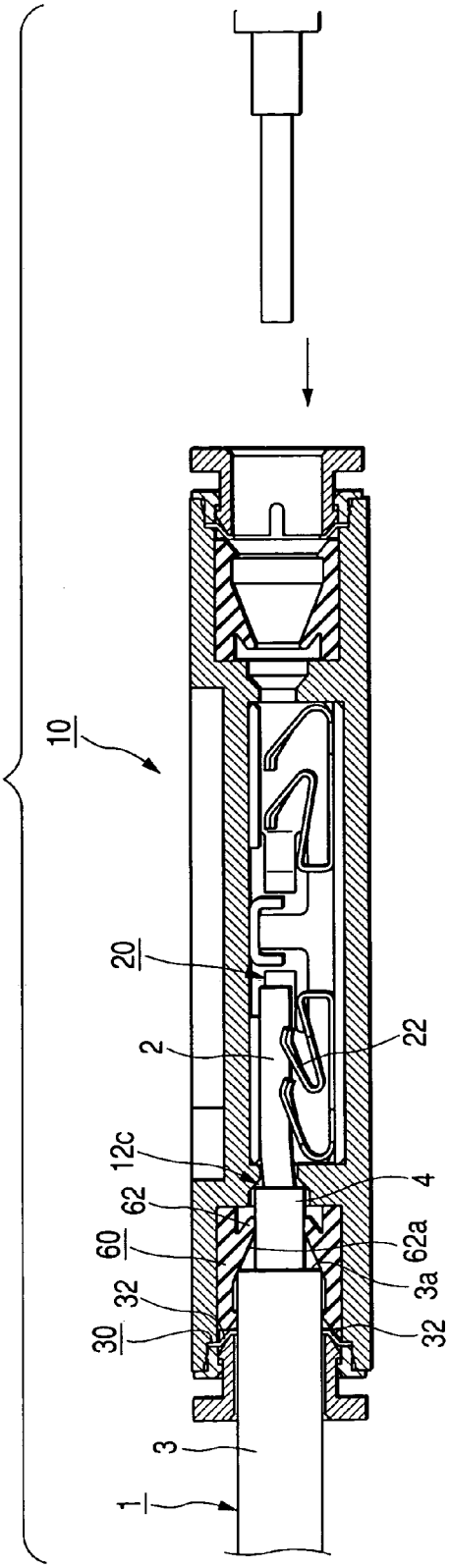
FIG. 4 shows a condition in which the lead wire is connected to the connector.

FIG. 4 shows a condition in which the lead wire is mounted in the connector.

The conductor 2 of the lead wire 1 has such a length that it passes through the through hole 12*c*, and further extends beyond the spring-like contact portion 22.

An end portion of the inner covering 4, exposed by removing the outer covering 3, has such a length that this exposed inner covering 4, extending from a terminal-side end 3*a* of the outer covering 3, reaches a position within the through hole 12*c*.

The outer covering 3 is inserted in such a manner that the end 3*a* thereof abuts against a tapering portion 62*a* of a first projection 62 of the elastic portion 60.

The resilient claws 32 of the retaining spring member 30, inclined in the lead wire inserting direction, bite into the outer covering 3 to retain the lead wire 1.

The insertion of the lead wire 1, as well as the retaining structure provided by the retaining spring member 30, will be described.

Figure 5A:
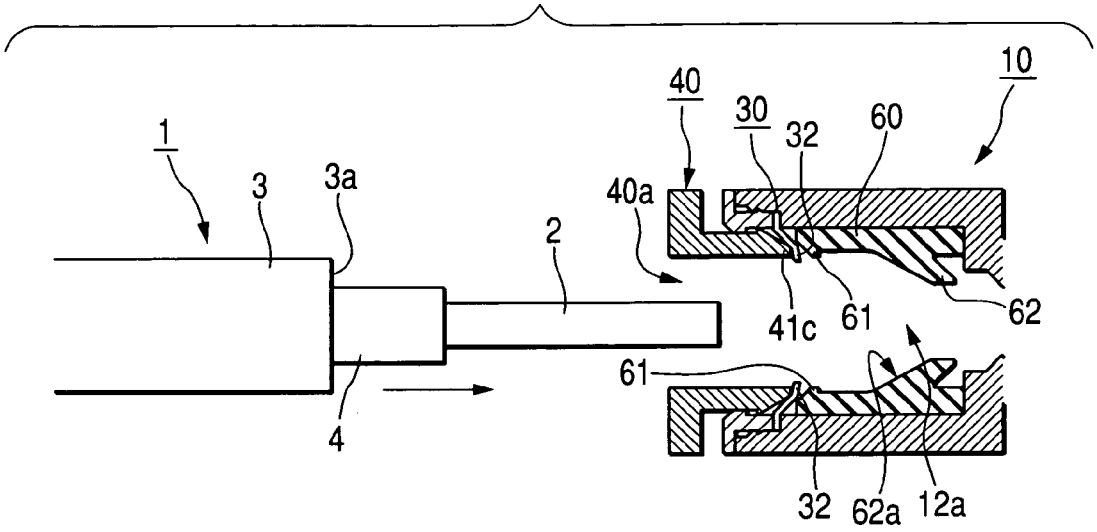
FIG. 5A is a schematic cross-sectional view.

FIG. 5A shows a condition before the lead wire 1 is inserted into the waterproof relay connector 10.

The lead wire 1 is passed through the hole 40*a* in the push-in member 40, with the conductor 2 directed forwardly, and is further passed between the resilient claws 32 of the retaining spring member 30, and is further passed through a through hole of the elastic portion 60.

Figure 5B:
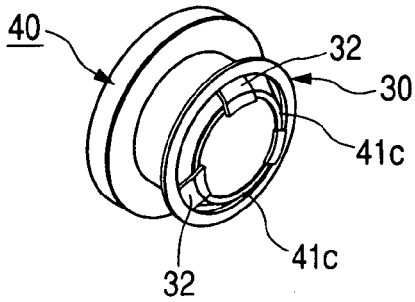
FIG. 5B is a schematic perspective view of an important portion.

FIG. 5B is a perspective view of the push-in member and the retaining spring member before the lead wire is inserted through these members.

The terminal-side end 41*c* of the push-in member 40 is disposed in opposed relation to the resilient claws 32 of the retaining spring member 30.

Figure 6A:
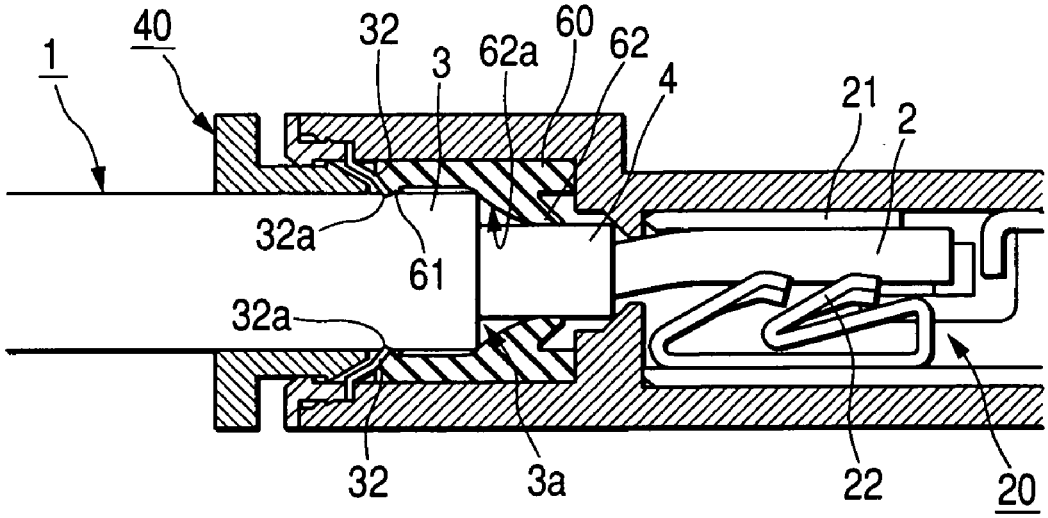
FIG. 6A is a schematic cross-sectional view.
Figure 6B:
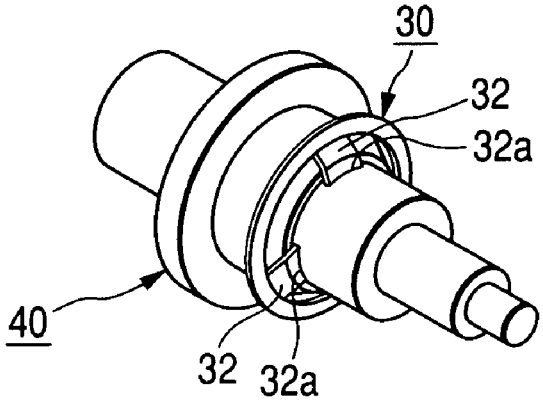
FIG. 6B is a schematic perspective view of an important portion.

FIG. 6A shows a condition in which the lead wire is mounted in the connector, and FIG. 6B is a perspective view schematically showing the push-in member 40, the retaining spring member 30 and the lead wire 1 in this condition.

The lead wire 1 is inserted between the spring-like contact portion 22 and conducting portion 21 of the terminal 20 to be contacted therewith, and is fixed thereto.

When the lead wire 1 is inserted between the resilient claws 32, their distal end portions 32*a* abut against the outer covering 3, and as this inserting operation proceeds, the distal end portions 32*a* are slightly resiliently deformed outwardly to be disposed on the outer covering 3, and their distal ends bite into the outer covering 3 uniformly in the circumferential direction.

With respect to the angle of biting of the resilient claws 32 into the outer covering 3, the distal end portions 32*a* of these resilient claws 32 are inclined toward the terminal 20, and therefore when a force, tending to withdraw the lead wire 1, acts on the lead wire, the distal end portions 32*a* of the resilient claws 32 bite into the outer covering 3 uniformly in the circumferential direction, thereby preventing the withdrawal of the lead wire 1 in a well-balanced manner in the circumferential direction.

The outer covering 3 of the lead wire 1 passes between the resilient claws 32, and enters the hole in the elastic portion 60, and in this condition this outer covering 3 is contacted at its outer periphery with a second projection 61 that is formed on an inner periphery 60*a* of the elastic portion 60 so as to seal the outer covering, and further abuts at its terminal-side end 3*a* against the tapering portion 62*a* of the first projection 62, thus forming a seal also at this end 3*a*.

The first projection 62 is held in contact with the outer periphery of the inner covering 4.

The lead wire 1 is retained by the resilient claws 32 disposed uniformly in the circumferential direction, and therefore the lead wire 1 is held in contact with the second projection 61, the tapering portion 62*a* of the first projection 61 and the first projection 62, which are formed on the inner periphery 60*a* of the elastic portion 60 in an annular manner in the circumferential direction, so that the good sealed condition which is not uneven in the circumferential direction can be achieved.

Figure 8:
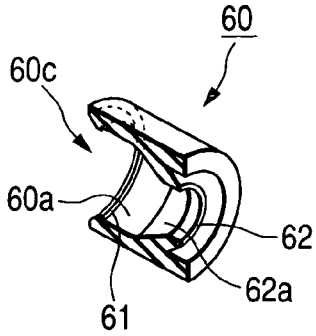
FIG. 8 is a perspective view showing one of two halves of a elastic portion cut in a direction of a length thereof.

FIG. 8 is a perspective view showing the cross-section of the elastic portion which is cut in a plane passing through the center axis of this elastic portion, with a half on this side removed.

The second projection 61 and the first projection 62 are formed on the substantially-cylindrical inner periphery 60*a* of the elastic portion 60 in an annular manner in the circumferential direction, and project toward the center axis of the elastic portion 60.

These projections 61 and 62 are inclined in the lead wire inserting direction so that the lead wire 1 can be easily inserted.

The tapering portion 62*a* of the first projection 62, generally facing a lead wire insertion port 60*c*, is inclined at such a suitable angle that the terminal-side end 3*a* of the outer covering 3 can suitably abut against this tapering portion 62*a* to form a seal line.

The seal structure, provided by the elastic portion, will be described.

Figure 9A:
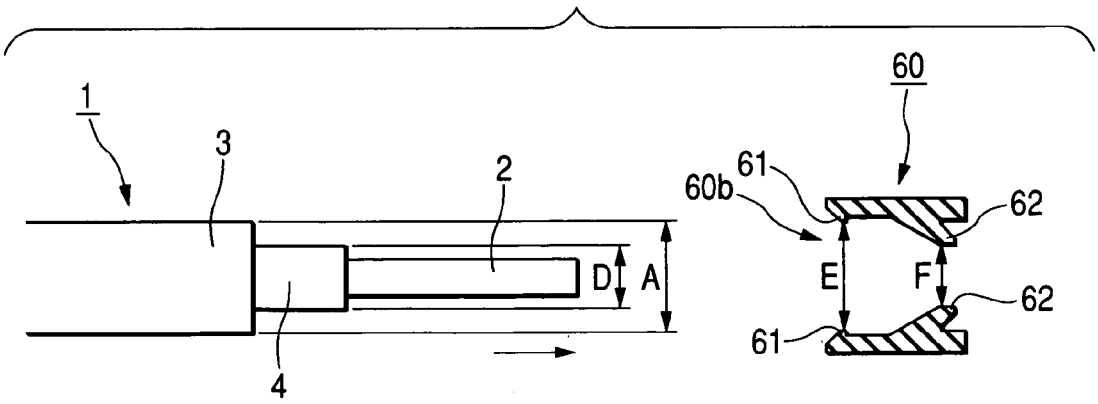
FIG. 9A shows the condition before the lead wire is mounted and FIG. 9B shows a condition in which the lead wire is mounted.
Figure 9B:
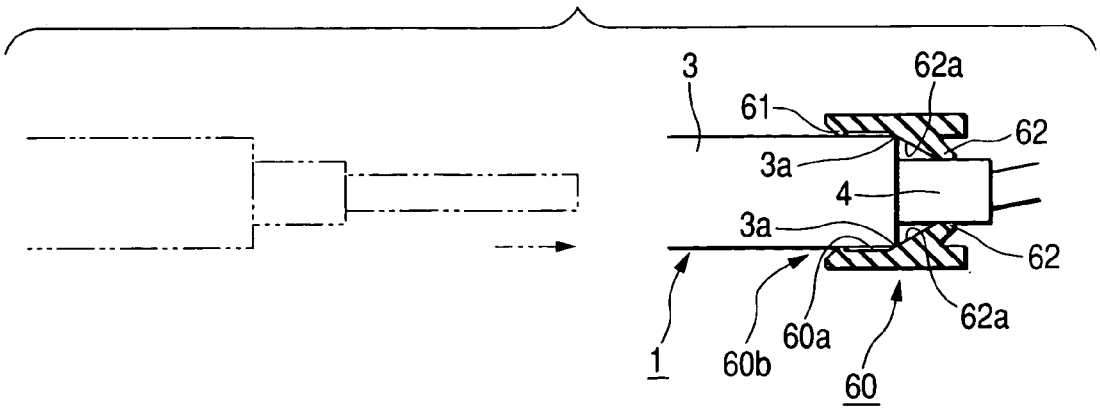

FIG. 9A is a schematic view showing the elastic portion and the lead wire before the lead wire is mounted in the connector, and FIG. 9B is a schematic view showing a condition in which the lead wire is mounted in the connector.

Here, the cross-section of the elastic portion is shown.

In FIG. 9A, the two projections, that is, the second projection 61 and the first projection 62, are formed on the inner periphery 60*a* of the elastic portion 60, and are arranged in this order from the lead wire insertion port 60*c*.

An inner diameter E of the second projection 61 is smaller than the diameter A of the outer covering 3, and an inner diameter F of the first projection 62 is smaller than an outer diameter D of the inner covering 4.

Therefore, in the lead wire-mounted condition in which the lead wire is connected to the terminal, the second projection 61 contacts the outer periphery of the outer covering 3 over the entire periphery thereof to form a seal line, while the first projection 62 contacts the outer periphery of the inner covering 4.

Also, the end 3*a* of the outer covering 3 of the lead wire abuts against the tapering portion 62*a* of the first projection 62 generally facing the lead wire insertion port 60*c*, so that the seal portion is formed in a stable manner since the lead wire is retained by the retaining spring member 30 against withdrawal.

As a result, the seal lines are formed respectively at three regions in the elastic portion 60, that is, at the second projection 61, the tapering portion 62*a* and the first projection 62.

Thus, the sealing lines of the multiple structure are formed, and therefore the excellent sealing performance is obtained.

For removing the lead wire 1, the retaining condition of the resilient claws 32 is canceled.

Figure 7A:
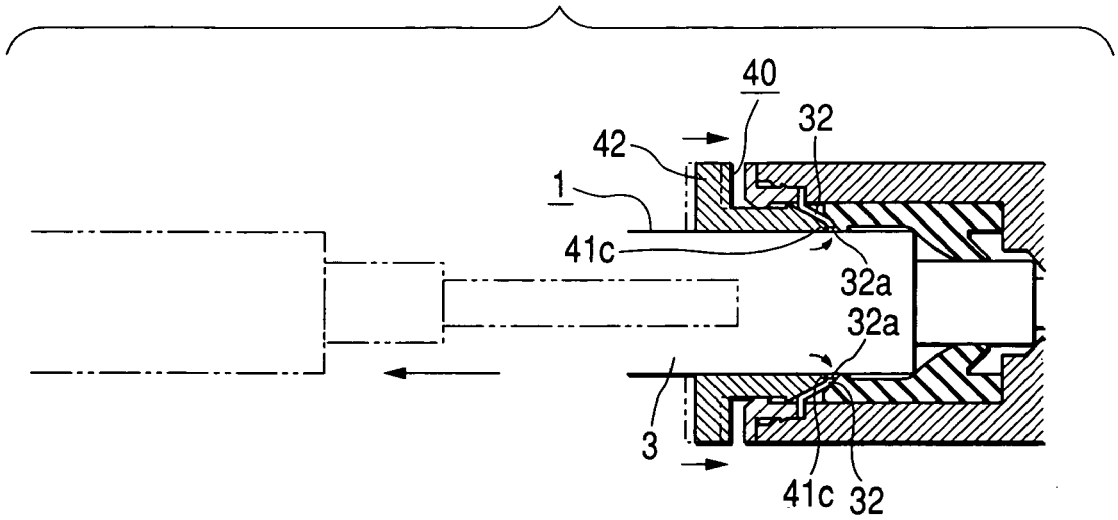
FIG. 7A is a schematic cross-sectional view.
Figure 7B:
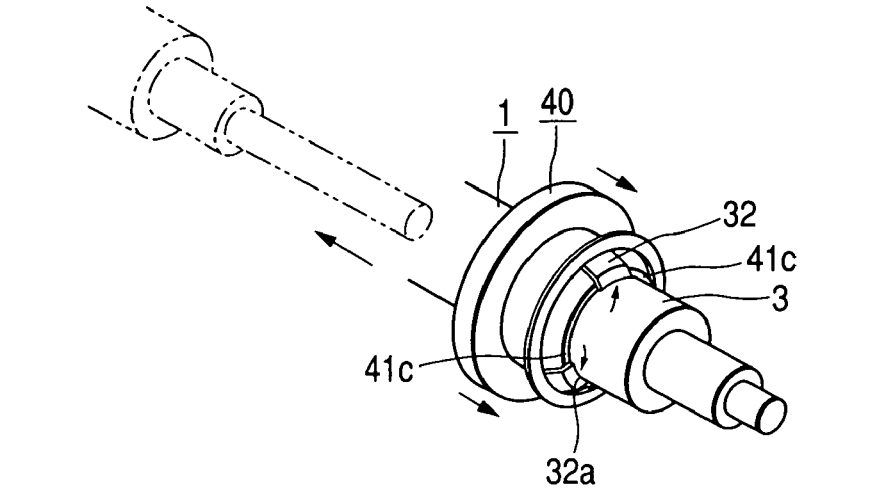
FIG. 7B is a schematic perspective view of an important portion.

When the flange 42 of the push-in member 40 is pushed toward the terminal as shown in FIGS. 7A and 7B, the end 41*c* of the push-in member 40, disposed in opposed relation to the resilient claws 32, slides toward the terminal.

As a result, the end 41*c* forces the resilient claws 32 inwardly, so that the resilient claws 32 are resiliently deformed toward the terminal.

Therefore, the resilient claws 32, biting into the outer covering 3, are further resiliently deformed toward the terminal, and the distal end portions 32*a* of the resilient claws 32 are brought out of biting engagement with the outer covering 3, and cancel the retaining of the lead wire 1.

Namely, by pushing the push-in member 40, the retained condition of the lead wire 1 can be canceled, and therefore the lead wire 1 can be easily removed from the connector.

Figure 10:
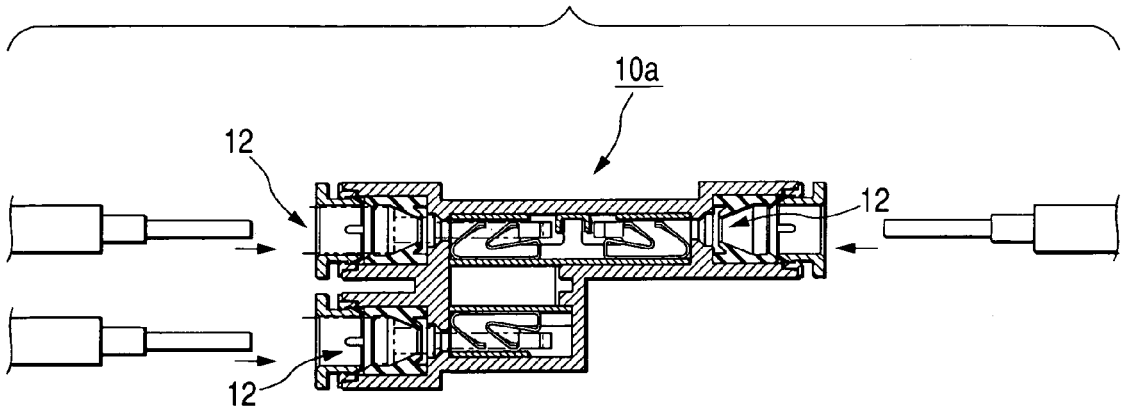
FIG. 10 shows an example of a waterproof relay connector of the multi-pole type.

FIG. 10 shows an example of a waterproof relay connector of the parallel connection type.

This is the waterproof relay connector of the multi-pole type, and a plurality of lead wire insertion holes 12 are formed in the connector 10*a*, and connection portions are provided in these holes 12, respectively.

Figure 11:
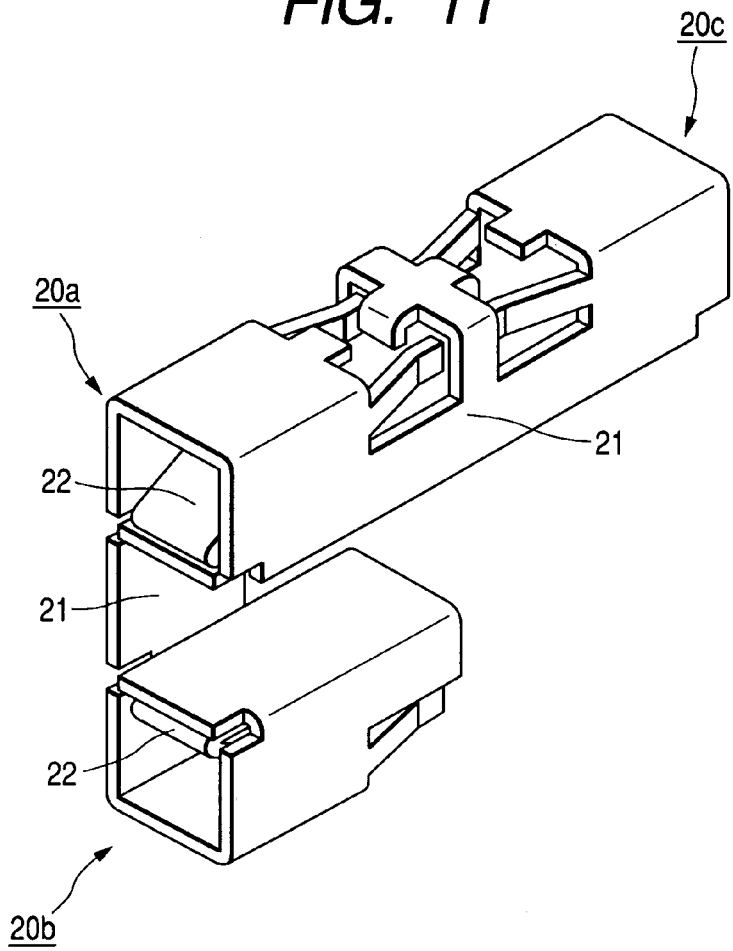
FIG. 11 is a perspective view of a terminal receiving portion.
Figure 12:
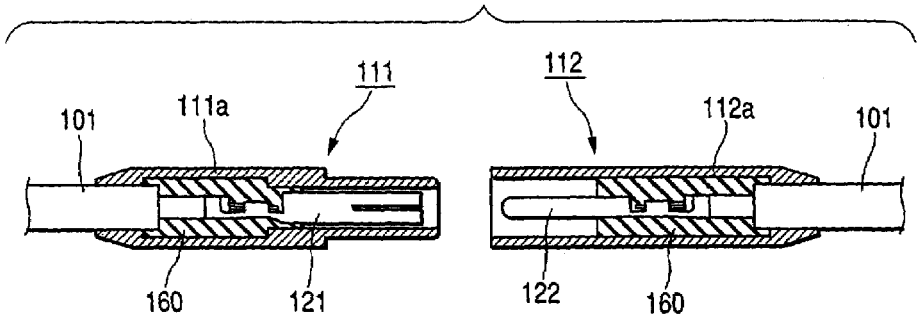
FIG. 12 shows a convention waterproof relay connector of the plug-socket type.
Figure 13:
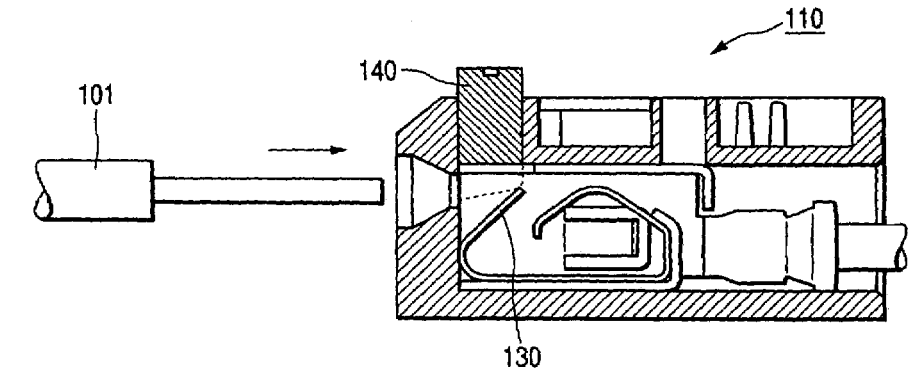
FIG. 13 shows an example of a connection structure of a terminal block.

FIG. 11 is a perspective view of terminals used in this connector.

Outer frames of the terminals 20*a*, 20*b* ad 20*c* are formed by respective conducting portions 21, and the terminals 20*a*, 20*b* and 20*c* are interconnected by the outer frames, and therefore are electrically connected to one another.

The conducting portions, forming the outer frames of the terminals, are suitably arranged to interconnect the terminals in accordance with a selected connection form of the connector.

Each lead wire is inserted between the conducting portion and a spring-like contact portion 22 of the corresponding terminal, and by doing so, this lead wire is connected to lead wires inserted respectively in the other terminals.

What is claimed is:

1. A waterproof relay connector comprising:

a connector housing;

a lead wire insertion hole that is formed through the connector housing;

a lead wire retaining portion that retains a lead wire and is inserted in the lead wire insertion hole;

an elastic portion that has a through hole through which the lead wire passes and is inserted in the lead wire insertion hole; and a terminal connected to the lead wire, wherein the lead wire is passed through the through hole of the elastic portion, and is connected to the terminal, so that a seal is formed between an inner peripheral surface of the through hole of the elastic portion and the lead wire, wherein the lead wire retaining portion includes a retaining spring member that has resilient claws therein, which are resiliently deformed in a lead wire inserting direction and bite into a covering portion of the lead wire, and a push-in member that pushes the resilient claws in the lead wire inserting direction, so that retaining the lead wire is canceled.

2. A waterproof relay connector according to claim 1, wherein the elastic portion is inserted in the lead wire insertion hole before the lead wire retaining portion.

3. A waterproof relay connector according to claim 1, wherein a projection is formed on the inner periphery of the through hole of the elastic portion, and a covering portion of the lead wire is held in contact with the projection, so that the seal is formed between the elastic portion and the lead wire.

4. A waterproof relay connector comprising:

a connector housing;

a lead wire insertion hole that is formed through the connector housing;

a lead wire retaining portion that retains a lead wire and is inserted in the lead wire insertion hole;

an elastic portion that has a through hole through which the lead wire passes and is inserted in the lead wire insertion hole; and a terminal connected to the lead wire, wherein the lead wire includes a conductor, an inner covering that covers the conductor and an outer covering that covers the conductor and the inner covering, a first projection and a second projection are formed on an inner periphery of the through hole of the elastic portion, and the lead wire is passed through the through hole of the elastic portion, and is connected to the terminal and the inner covering and the outer covering are held in contact with the first projection and the second projection respectively, so that seals are formed between the inner peripheral surface of the through hole of the elastic portion and the lead wire.

5. A waterproof relay connector according to claim 4, wherein the first projection and the second projection extend in a direction of a central axis of the through hole and incline in a lead wire inserting direction.

6. A waterproof relay connector according to claim 5, wherein an end of the outer covering is held in contact with a tapering portion of the first projection, so that a seal is formed between the elastic portion and the lead wire.

7. A waterproof relay connector according to claim 6, wherein the end of the outer covering and the inner covering are held in contact with different points of the first projection, so that seals are formed between the elastic portion and the lead wire.

8. A waterproof relay connector according to claim 4, wherein the lead wire retaining portion includes a retaining spring member that has resilient claws therein, which are resiliently deformed in a lead wire inserting direction and bite into a covering portion of the lead wire.

9. A waterproof relay connector according to claim 1, wherein the push-in member includes a flange that projects from the connector housing outwardly.

10. A waterproof relay connector according to claim 1, wherein the connector housing includes a plurality of lead wire insertion holes, and lead wires that are inserted respectively in the lead wire insertion holes can be electrically connected each other in a series or a parallel manner via the terminals.

* * * * *